US007703899B2

(12) United States Patent
Chikamoto et al.

(10) Patent No.: US 7,703,899 B2
(45) Date of Patent: Apr. 27, 2010

(54) INK-JET HEAD

(75) Inventors: Tadanobu Chikamoto, Nagoya (JP); Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 582 days.

(21) Appl. No.: 11/612,261

(22) Filed: Dec. 18, 2006

(65) Prior Publication Data

US 2007/0139463 A1 Jun. 21, 2007

(30) Foreign Application Priority Data

Dec. 16, 2005 (JP) ..... 2005-362834

(51) Int. Cl.
*B41J 2/175* (2006.01)

(52) U.S. Cl. ..... 347/85

(58) Field of Classification Search ..... 347/42, 347/85, 89, 29

See application file for complete search history.

(56) References Cited

U.S. PATENT DOCUMENTS 6,003,981 A * 12/1999 Cameron et al. ..... 347/85
6,217,164 B1 * 4/2001 Hino ..... 347/85
6,886,926 B2 5/2005 Kaga et al.

FOREIGN PATENT DOCUMENTS

JP 200380725 A 3/2003

* cited by examiner

*Primary Examiner*—Stephen D Meier
*Assistant Examiner*—Geoffrey Mruk
(74) *Attorney, Agent, or Firm*—Baker Botts L.L.P.

(57) ABSTRACT

An ink-jet head has a flexible tube, a passage component, a tubular joint protruding from a surface of the passage component and fitted into the tube, and a cap covering a portion of the tube fitted with the joint. A hole is formed on the surface of the passage component. The cap includes a tubular portion having such an inside diameter as to allow the tube to pass therethrough, a protrusion protruding inward from an inner surface of the tubular portion, and an extending portion extending toward the hole from an end of the tubular portion confronting the surface of the passage component. An end of the protrusion is positioned between an inside diameter position and an outside diameter position of the portion of the tube fitted with the joint. A hook engageable with a peripheral edge of the hole is formed at the extending portion.

8 Claims, 11 Drawing Sheets

INK-JET HEAD

BACKGROUND OF THE INVENTION

1. Field of the Invention

The present invention relates to an ink-jet head that ejects ink from a nozzle.

2. Description of Related Art

Japanese Patent Unexamined Publication No. 2003-80725 discloses an ink-jet recording apparatus having a recording head unit, an ink tank, and a tube. The recording head unit includes a recording head that ejects ink to a record medium. The ink tank stores therein ink which will be supplied to the recording head unit. The tube supplies ink from the ink tank to the recording head unit. Provided inside the recording head unit is an air trap unit that traps air bubbles generated in the tube. The air trap unit includes a tubular joint that is fitted in the tube. The joint has a neck and a head of tapered shape. The neck protrudes from a main body of the joint. The head is expanded from the neck, and reduced in diameter toward the tube. A fixing member is attached to a portion of the tube fitted with the joint, so that the tube is fixed to the joint.

SUMMARY OF THE INVENTION

However, in the ink-jet recording apparatus disclosed in the above-mentioned document, the fixing member clamps the portion of the tube merely circumferentially. Therefore, if the tube receives such force that pulls the tube out of the joint, the fixing member as well as the tube gets moving in such a direction. Consequently, the tube can easily fall out of the joint.

An object of the present invention is to provide an ink-jet head that makes it difficult for a tube to fall out of the joint.

According to an aspect of the present invention, there is provided an ink-jet head comprising a flexible tube, a passage component, a tubular joint, and a cap. The tubular joint protrudes from a surface of the passage component and is fitted into the tube. The cap covers a portion of the tube fitted with the joint. A hole is formed on the surface of the passage component. The cap includes a tubular portion, a protrusion, and an extending portion. The tubular portion has such an inside diameter as to allow the tube to pass therethrough. The protrusion protrudes inward from an inner surface of the tubular portion. The extending portion extends toward the hole from an end of the tubular portion confronting the surface of the passage component. An end of the protrusion is positioned between an inside diameter position and an outside diameter position of the portion of the tube fitted with the joint. A hook engageable with a peripheral edge of the hole is formed at the extending portion.

In the aspect, the protrusion of the cap presses, to the joint, the portion of the tube fitted with the joint, thereby fixing the tube to the joint. In addition, the hook of the cap is engaged with the peripheral edge of the hole of the passage component, so that the cap is fixed to the passage component. Therefore, as compared with when clamping the tube merely circumferentially, it is more unlikely that the tube falls out of the joint.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described with reference to the accompanying drawings.

Figure 1:
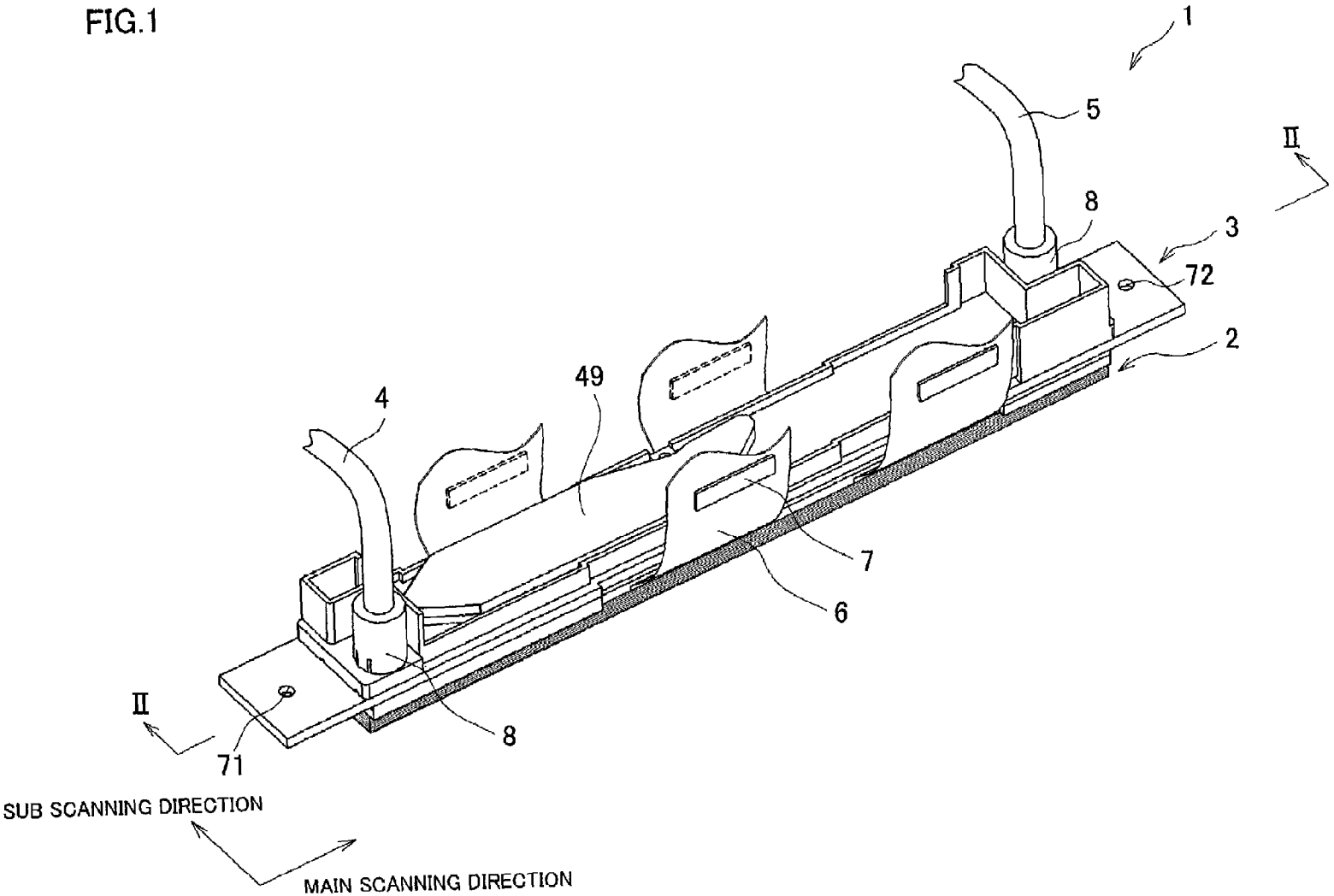
FIG. 1 is a perspective view of an external appearance of an ink-jet head according to an embodiment of the present invention.

FIG. 1 is a perspective view of an external appearance of an ink-jet head according to an embodiment of the present invention. As shown in FIG. 1, an ink-jet head 1 is elongated in a main scanning direction and has, from down to top, a head main body 2 and a reservoir unit 3. The head main body 2 is opposed to a record medium. The reservoir unit 3 temporarily stores ink therein. The ink-jet head 1 also has an ink supply tube 4, an ink discharge tube 5, and caps 8. The ink supply tube 4 and the ink discharge tube 5 are connected respectively to both ends of the reservoir unit 3 with respect to the main scanning direction. The caps 8 fix the ink supply tube 4 and the ink discharge tube 5 to the reservoir unit 3. One end of the ink supply tube 4 is connected to the reservoir unit 3, and the other end thereof is connected to an unillustrated ink tank. Ink is supplied from the ink tank to the reservoir unit 3 through the ink supply tube 4. One end of the ink discharge tube 5 is connected to the reservoir unit 3, and the other end thereof is connected to an unillustrated waste ink tank.

Four FPCs (Flexible Printed Circuits) 6, which work as power supply members, are put on an upper face of the head main body 2, and extend upward through a space between the head main body 2 and the reservoir unit 3. One end of the FPC 6 is connected to an actuator unit 21 which will be described later, and the other end thereof is connected to an unillustrated control board. A driver IC 7 is mounted on the FPC 6 at a point midway from the actuator unit 21 to the control board. That is, the FPC 6 is electrically connected to the control board and the driver IC 7, so that it transmits an image signal outputted from the control board to the driver IC 7 and supplies a drive signal outputted from the driver IC 7 to the actuator unit 21.

Figure 2:
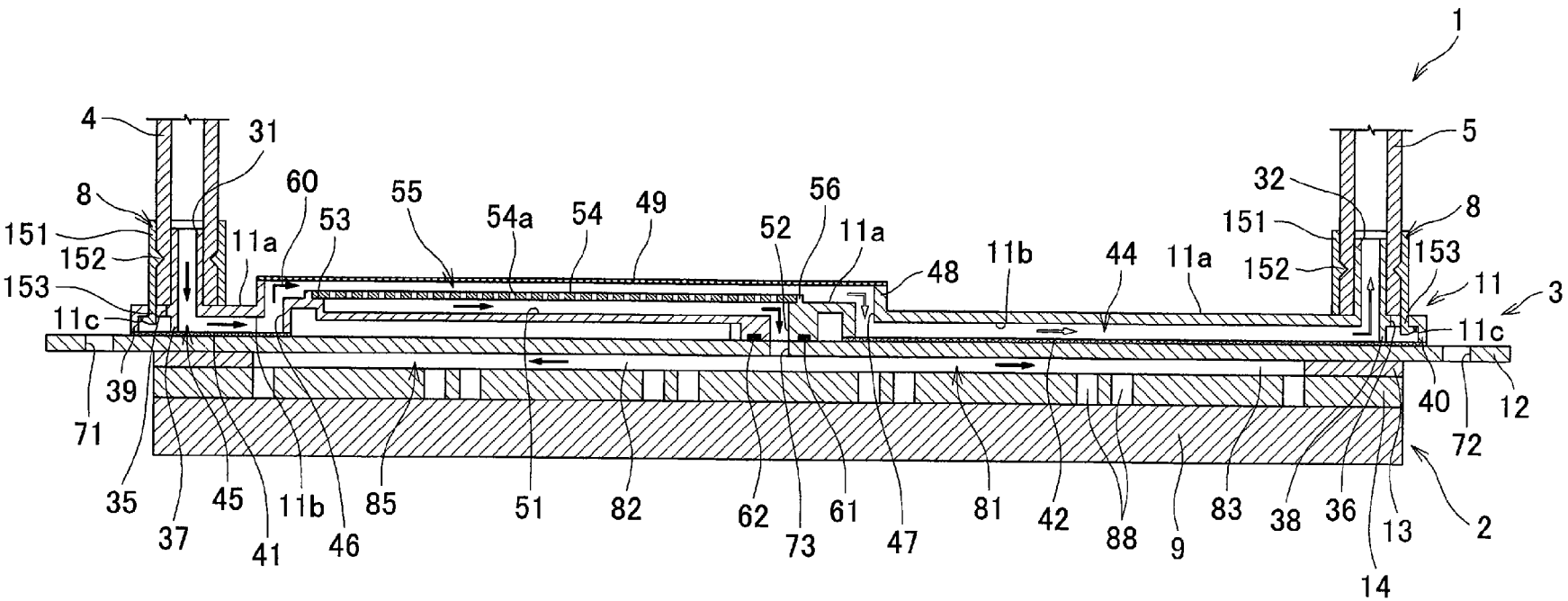
FIG. 2 is a sectional view as taken along line II-II of FIG. 1.
Figure 3:
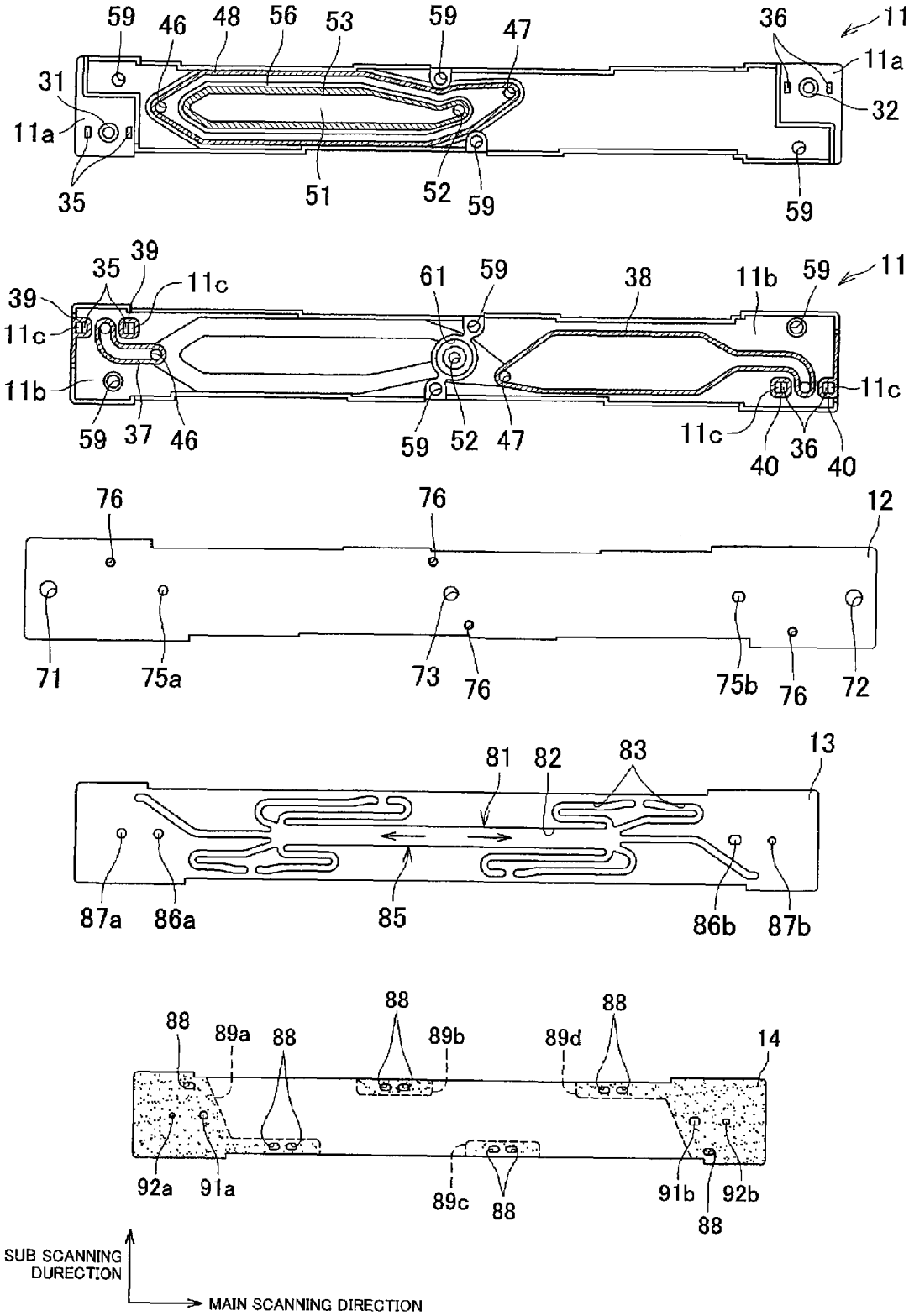
FIG. 3 is a set of exploded plan views of a reservoir unit that is included in the ink-jet head.
Figure 4:
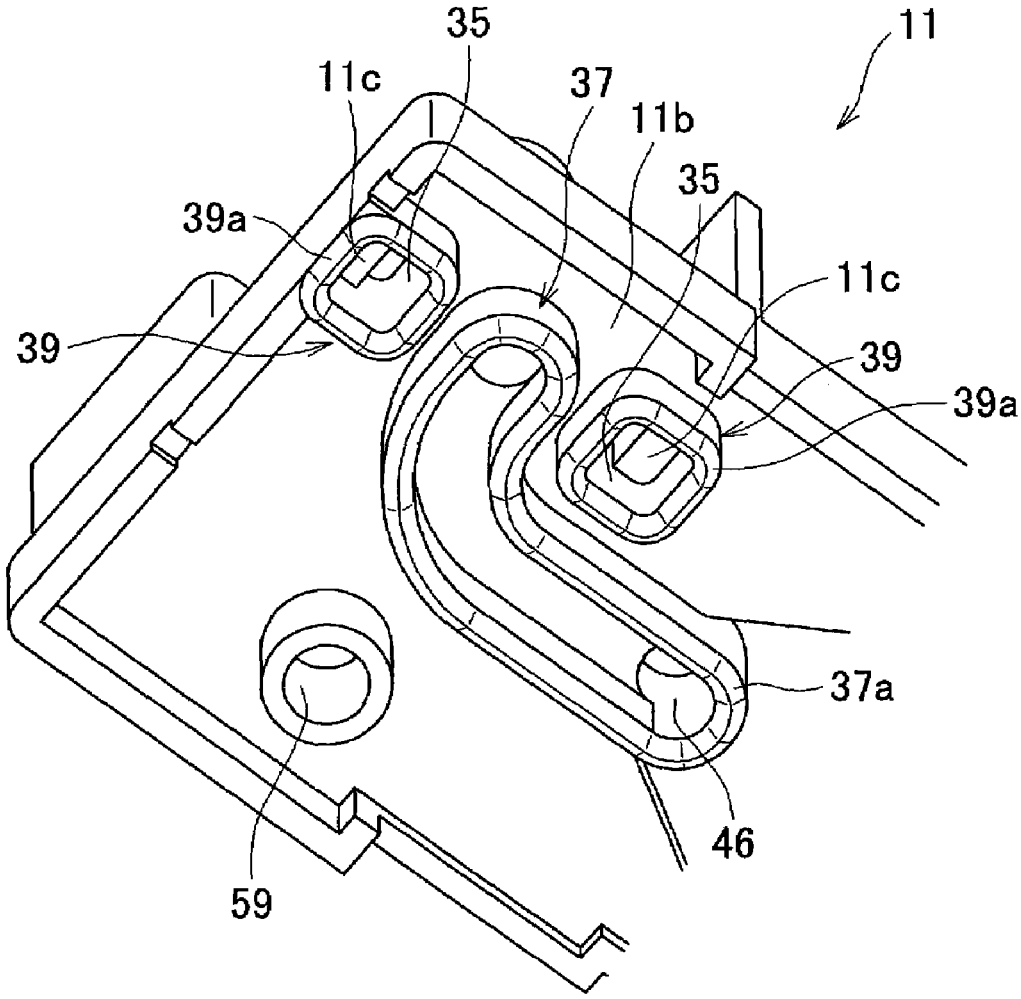
FIG. 4 is a perspective view of a part of a passage component that is included in the reservoir unit, as seen at an angle from below.
Figure 5:
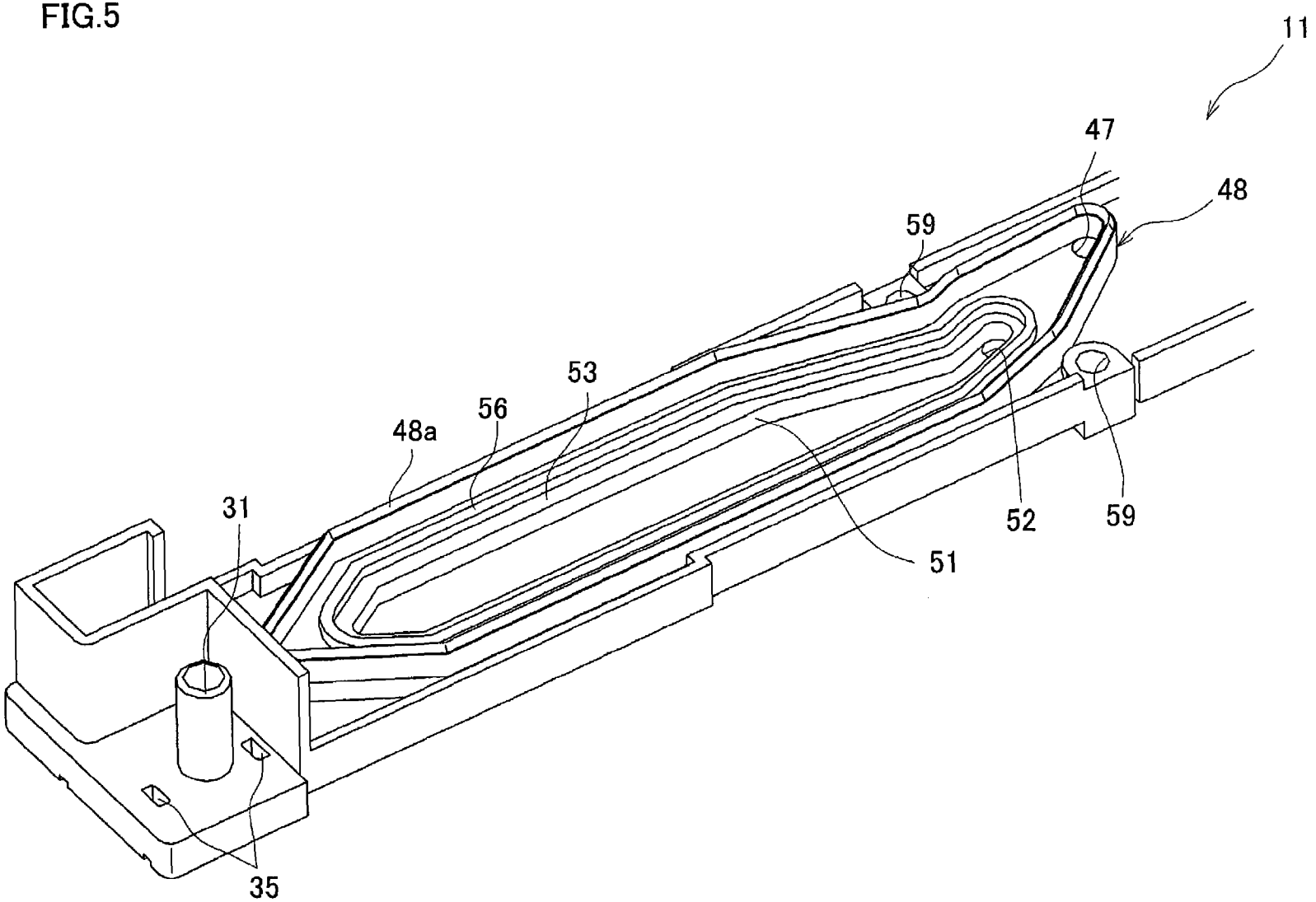
FIG. 5 is a perspective view of a part of the passage component, as seen at an angle from above.

FIG. 2 is a sectional view of the ink-jet head 1. FIG. 3 is a set of exploded plan views of the reservoir unit 3. FIG. 4 is a perspective view of a part of a passage component 11 that is included in the reservoir unit 3, as seen at an angle from below. FIG. 5 is a perspective view of a part of the passage component 11, as seen at an angle from above. In FIG. 2, for the purpose of explanatory convenience, the ink-jet head 1 is scaled up in its thickness direction. Besides, an ink passage formed in the reservoir unit 3 is illustrated, although it actually does not appear on a section taken along an identical line. Among the views of FIG. 3, the uppermost one is the passage component 11 as seen from above, and the second uppermost one is the passage component 11 as seen from below. In FIGS. 3 to 5, films 41, 42, 49, and a filter plate 54 which are shown in FIG. 2 are omitted in order that a structure of the passage component 11 can easily be understood.

The reservoir unit 3 temporarily stores ink therein, and supplies ink to a passage unit 9 which is included in the head main body 2. As shown in FIG. 3, the reservoir unit 3 has a layered structure in which the passage component 11 and three plates 12 to 14 are layered. The passage component 11 is elongated in the main scanning direction. Each of the three plates 12 to 14 has a rectangular plane elongated in the main scanning direction. The passage component 11 is made of a synthetic resin such as a polyethylene terephthalate resin, a polypropylene resin, and the like. The plates 12 to 14 are metal plates made of, e.g., SUS430.

As shown in FIGS. 2 and 3, in vicinities of one longitudinal end and the other longitudinal end of the passage component 11, cylindrical joints 31 and 32 protrude from a surface 11*a* of the passage component 11. The joint 31 is fitted into the ink supply tube 4. The joint 32 is fitted into the ink discharge tube 5. A pair of holes 35 and a pair of holes 36 are formed near the joints 31 and 32, respectively. The holes 35 and 36 penetrate from the surface 11*a* to a back face 11*b*.

As shown in FIGS. 3 and 4, annular walls 37 and 38 protrude from the back face 11*b* of the passage component 11. The annular walls 37 and 38 enclose regions that correspond to the joints 31 and 32, respectively. Both of the annular walls 37 and 38 are opened toward the plate 12. In a plan view, the annular wall 37 curves into an L-shape, from a point corresponding to the joint 31. In a plan view, the annular wall 38 curves into an L-shape, from a point corresponding to the joint 32. A space in the annular wall 38 with respect to a sub scanning direction is increased from the point corresponding to the joint 32, and reduced in the vicinity of a center of the passage component 11.

A pair of tubular walls 39 and a pair of tubular walls 40 are protrudingly formed on the back face 11*b*. The pair of walls 39 and the pair of walls 40 enclose the pair of holes 35 and the pair of walls 36, respectively. As shown in FIGS. 2 and 4, the tubular walls 39 and 40 are partially spaced from peripheral edges of the respective holes 35 and 36, so that steps 11*c* appear between inner faces of the holes 35, 36 and inner faces of the tubular walls 39, 40. Ends 39*a* and 40*a* of the tubular walls 39 and 40 are, with respect to a direction perpendicularly crossing the back face 11*b*, at the same level as ends 37*a* and 38*a* of the annular walls 37 and 38 are.

As shown in FIG. 4, each of the end 37*a* of the annular wall 37 and the ends 39*a* of the tubular walls 39 has a tapered shape. The end 37*a* of the annular wall 37 and the ends 39*a* of the tubular walls 39 are heated and melted through a film 41, so that the annular wall 37 and the tubular walls 39 are adhered to the film 41 (see FIG. 2). In the second uppermost view of FIG. 3, hatched regions shown at a left side are regions adhered to the film 41. Openings of the annular wall 37 and the tubular walls 39 are thereby sealed, thus forming a space enclosed with the back face 11*b*, the annular wall 37, and the film 41. That is, a flow-in passage 45 communicating with the joint 31 and with a later-described hole 46 is formed.

Since the end 37*a* of the annular wall 37 and the ends 39*a* of the tubular walls 39 are at the same level, the same film 41 can be adhered to the ends 37*a* and 39*a* simultaneously.

Since the end 37*a* of the annular wall 37 and the ends 39*a* of the tubular walls 39 have tapered shapes, they are easily melted when heated. Therefore, by heating the end 37*a* of the annular wall 37 and the ends 39*a* of the tubular walls 39 through the film 41, the film 41 can easily be adhered to the annular wall 37 and the tubular walls 39 while preventing melting of a portion of the annular wall 37 and portions of the tubular walls 39 other than the ends 37*a* and 39*a*. Even if flatness of the ends 37*a* and 39*a* are inaccurate, inaccuracy can be compensated at this time because the ends 37*a* and 39*a* are melted down.

Like the end 37*a* of the annular wall 37 and the ends 39*a* of the tubular walls 39, an end of the annular wall 38 and ends of the tubular walls 40 have tapered shapes. In the same manner as described above, the ends are melted so that the annular wall 38 and the tubular walls 40 are adhered to a film 42 (see FIG. 2). In the second uppermost view of FIG. 3, hatched regions shown at a right side are regions adhered to the film 42. Openings of the annular wall 38 and the tubular walls 40 are thereby sealed. Thus, in a space enclosed with the back face 11*b*, the annular wall 38, and the film 42, a discharge passage 44 communicating with the joint 32 and a later-described hole 47 is formed.

As shown in FIG. 2 and in the uppermost and the second uppermost views of FIG. 3, circular holes 46 and 47 are formed on the surface 11*a* of the passage component 11 and penetrate to the back face 11*b*. The hole 46 is positioned so as to communicate with a downstream end of the flow-in passage 45. The hole 47 is formed at a position that is a little closer to the joint 32 than the center of the passage component 11 is. The hole 47 is positioned so as to communicate with an upstream end of the discharge passage 44.

As shown in the uppermost view of FIG. 3 and in FIG. 5, an annular wall 48 that encloses the hole 46 and the hole 47 protrudes from the surface 11*a*. In a plan view, a space in the annular wall 48 with respect to the sub scanning direction is increased along a longitudinal direction of the passage component 11 from a vicinity of the hole 46 to a vicinity of both sides of the passage component 11, and then the annular wall 48 extends along the both sides to a vicinity of the center, and then the space is reduced toward the hole 47. As shown in FIG. 5, an end 48*a* of the annular wall 48 has a tapered shape. The end 48*a* of the annular wall 48 is heated and melted through a film 49, so that the annular wall 48 is adhered to the film 49 (see FIG. 2). The uppermost view of FIG. 3 shows two annular hatched regions, the external one of which is a region that is adhered to the film 49. The film 49 has flexibility, and its upper face is touched by the atmosphere. The film 49 also works as a damper for damping vibration of ink. An opening of the annular wall 48 is thereby sealed, thus forming a space enclosed with the surface 11*a*, the annular wall 48, and the film 49. That is, a filter chamber 55 in which a later-described filter plate 54 is provided is formed.

Since the end 48*a* of the annular wall 48 has a tapered shape, it is easily melted when heated. Accordingly, by heating the end 48*a* of the annular wall 48 through the film 49, the film 49 can easily be adhered to the annular wall 48 while preventing melting of a portion of the annular wall 48 other than the end 48*a*. Even if flatness of the end 48*a* is inaccurate, inaccuracy can be compensated at this time because the end 48*a* is melted down.

The films 41, 42, and 49 are made of a material having excellent gas barrier properties such as a PET (polyethylene terephthalate) film on which a silica film (SiOx film), an aluminum film, or the like is vapor-deposited. Thus, gas outside the ink-jet head 1 can hardly enter an ink passage of the passage component 11 through the film 41, 42, or 49.

As shown in FIGS. 2, 3, and 5, a concavity 51 is formed inside the annular wall 48. As shown in the uppermost view of FIG. 3, the concavity 51 extends from a vicinity of the hole 46 to a vicinity of the center of the passage component 11. In a plan view, a shape of the concavity 51 is similar to but slightly smaller than that of the annular wall 48. A circular hole 52 is formed on a bottom face of the concavity 51 and in the vicinity of the center of the passage component 11.

An annular face 53 is formed around the concavity 51. The annular face 53 extends horizontally outward from an outer edge of the concavity 51. A filter plate 54 (see FIG. 2) is supported on the annular face 53. The uppermost view of FIG. 3 shows two annular hatched regions, the internal one of which is the annular face 53. An outer edge of the annular face 53 is defined by an annular wall 56 that is protrudingly formed along an outer edge of the filter plate 54. A height of the annular wall 56 is lower than a height of the annular wall 48 that defines the filter chamber 55. The filter plate 54 is made of nickel manufactured through an electroforming process for example. Many fine holes 54*a* are formed in the filter plate 54.

As shown in FIG. 2, a curved passage 60 is formed in the passage component 11. The curved passage 60 extends from the hole 46 to the hole 52 through the filter chamber 55 and a space formed within the concavity 51. The curved passage 60 is connected also to the discharge passage 44 via the hole 47. On a lower face of the passage component 11, an annular groove 61 that opens downward is formed around the hole 52. An O-ring 62 is fitted in the annular groove 61.

As shown in FIG. 3, the passage component 11 has four circular holes 59 passing therethrough from the surface 11*a* to the back face 11*b*. Two of the holes 59 locate in a middle portion of the passage component 11 and two of them locate at both end portions of the passage component 11, with respect to the longitudinal direction of the passage component 11. The holes 59 are arranged point-symmetrically with respect to the center of the passage component 11.

As shown in FIGS. 2 and 3, circular holes 71 and 72 are formed at both longitudinal end portions of the plate 12 which is disposed just under the passage component 11. The holes 71 and 72 are used for fixing the ink-jet head 1 to a printer main body by use of screws or the like. The plate 12 has a circular hole 73 at its center, and positioning holes 75*a* and 75*b* at its portion a little closer to the center than the holes 71 and 72 are. The plate 12 further has four screw holes 76. Two of the screw holes 76 locate in a middle portion of the plate 12 and two of them locate at both end portions of the plate 12, with respect to the longitudinal direction of the plate 12. The screw holes 76 are arranged point-symmetrically with respect to the center of the plate 12. The screw holes 76 correspond to the above-described holes 59, respectively. By putting screws into the respective holes 59 and further screwing them into the screw holes 76 of the plate 12, the passage component 11 and the plate 12 are fixed to each other. At this time, the hole 52 of the passage component 11 and the hole 73 of the plate 12 are opposed to each other so that the curved passage 60 of the passage component 11 communicates with the hole 73. Since the O-ring 62 is fitted in the annular groove 61, ink does not leak out at an outlet of the curved passage 60 into between the passage component 11 and the plate 12.

As shown in FIGS. 2 and 3, a plate 13 which is disposed immediately under the plate 12, has a through hole 81. The through hole 81 forms a reservoir passage 85 that includes a main passage 82 and ten branch passages 83 communicating with the main passage 82. In a plan view, the reservoir passage 85 has a point-symmetrical shape with respect to a center of the plate 13. The main passage 82 extends along a longitudinal direction of the plate 13. Substantially a center of the main passage 82 corresponds to the hole 73 of the plate 12. A passage width of the branch passage 83 is smaller than a passage width of the main passage 82. All of the branch passages 83 have the same passage width, the same passage length, and substantially the same passage resistance. The plate 13 further has positioning holes 86*a* and 86*b* that correspond to the positioning holes 75*a* and 75*b* of the plate 12, respectively, and positioning holes 87*a* and 87*b* that are for positioning the plate 13 with a plate 14.

As shown in FIGS. 2 and 3, the lowermost plate 14 of the reservoir unit 3 has ink discharge holes 88 each having an elliptical shape. The ink discharge holes 88 are formed at positions corresponding to ends of the respective branch passages 83. The plate 14 further has four positioning holes 91*a*, 91*b*, 92*a*, and 92*b* corresponding to the positioning holes 86*a*, 86*b*, 87*a*, and 87*b* of the plate 13, respectively.

On a lower face of the plate 14, portions hatched in FIG. 3 protrude downward, to form protrusions 89*a*, 89*b*, 89*c*, and 89*d*. Each of the protrusions 89*a*, 89*b*, 89*c*, and 89*d* covers two or three ink discharge holes 88, and is fixed to an upper face of the passage unit 9 via a filter plate 95*a* or 95*b* (see FIG. 8). A portion of the plate 14 other than the protrusions 89*a* to 89*d* is spaced apart from the passage unit 9, so that a space is formed. The FPCs 6 (see FIG. 1) extend through the space.

By positioning pins (not shown) being inserted into the positioning holes 75*a*, 75*b*, 86*a*, 86*b*, 87*a*, 87*b*, 91*a*, 91*b*, 92*a*, and 92*b*, the three plates 12 to 14 are positioned with one another, and fixed by an adhesive. Thus, the reservoir unit 3 having the passage component 11 and the three plates 12 to 14 layered on one another is formed.

Next, a description will be given to how ink flows within the reservoir unit 3. Within the reservoir unit 3, the flow-in passage 45, the curved passage 60, the filter chamber 55, and the reservoir passage 85 are formed. Ink is temporarily stored in the reservoir unit 3.

As indicated by black arrows in FIG. 2, ink that has flown from the ink supply tube 4 through the joint 31 into the passage component 11 flows horizontally through the flow-in passage 45, and then flows upward through the hole 46, and then flows into the curved passage 60. In a case where the joint 32 is opened, some of the ink that has flown into the curved passage 60 flows through the hole 47 into the discharge passage 44 and then into the joint 32. At a time of initially introducing ink for example, by discharging ink from the joint 32, air existing on an upper face of the filter plate 54 is also discharged together with the ink, so that fresh ink is charged on an upstream side of the filter plate 54.

The ink that has flown into the filter chamber 55 passes through the holes 54*a* of the filter plate 54, and falls into the concavity 51. The ink that has fallen into the concavity 51 passes through the holes 52 and 73, and falls into the reservoir passage 85. Then, the ink flows from the center of the main passage 82 toward both longitudinal ends of the main passage 82, as indicated by arrows in the fourth view from the top of FIG. 3. The ink reaches the both longitudinal ends of the main passage 82, and flows into the respective branch passages 83. The ink that has flown into the respective branch passages 83 passes through the ink discharge holes 88 and holes (not shown) formed in the filter plates 95*a* and 95*b*, and then flows through ink supply ports 101 (see FIG. 8) into the passage unit 9.

The ink that has flown into the passage unit 9 is, as will be described later, distributed to many individual ink passages 132 (see FIG. 10) that communicate with manifold channels 105. The ink then reaches nozzles 108 which are terminals of the respective individual ink passages 132, and then ejected to outside.

Figure 6A:
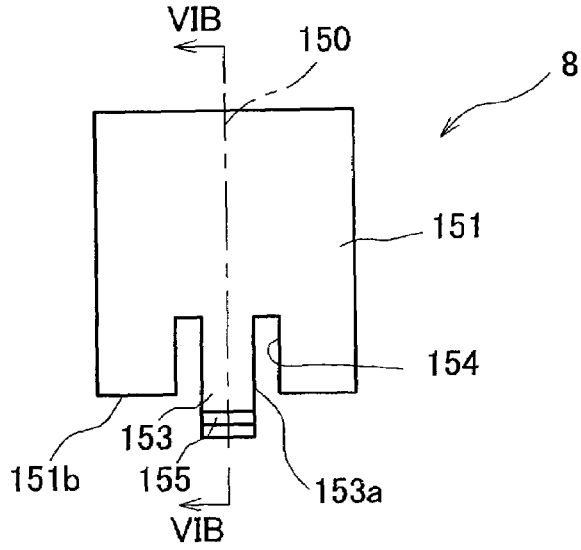
FIG. 6A is a side view of a cap.
Figure 6B:
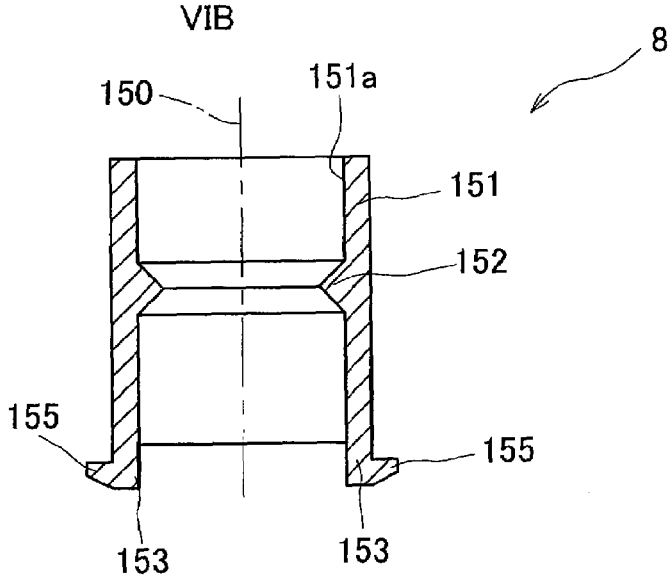
FIG. 6B is a sectional view taken along line VIB-VIB of FIG. 6A.
Figure 6C:
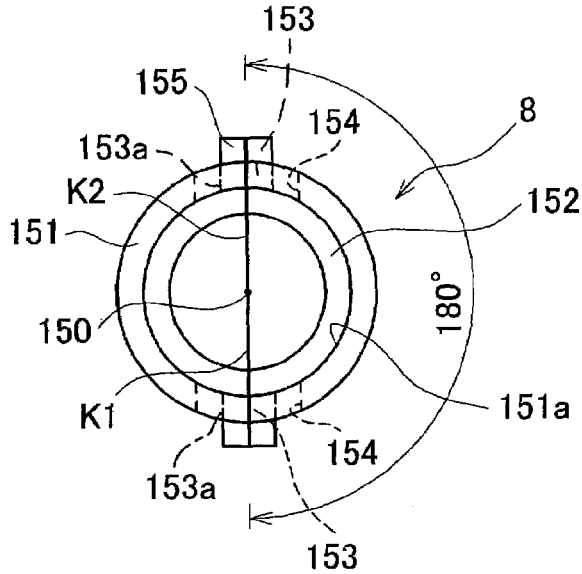
FIG. 6C is a plan view of the cap.
Figure 7A:
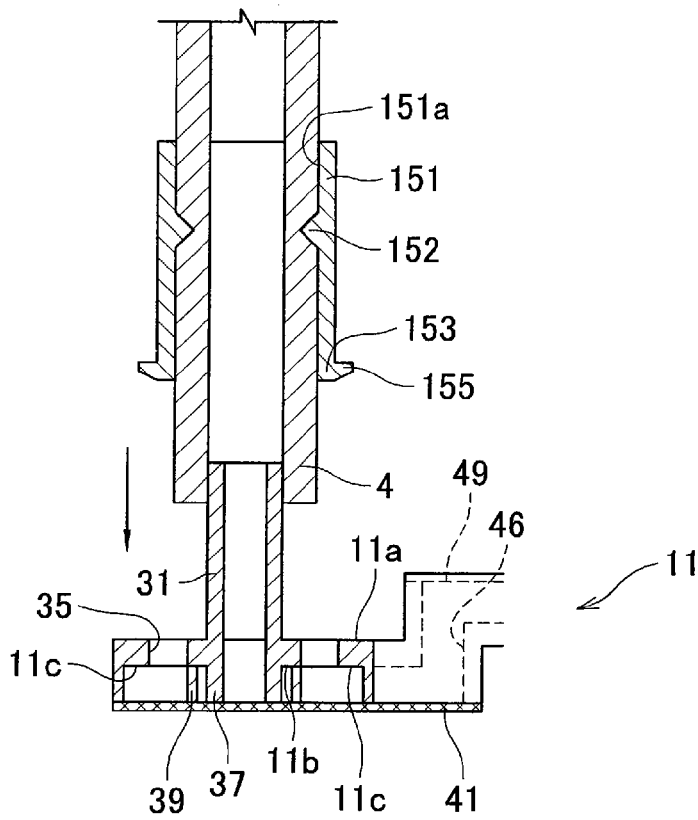
FIGS. 7A and 7B illustrate a situation of fixing an ink supply tube to a joint of the passage component.
Figure 7B:
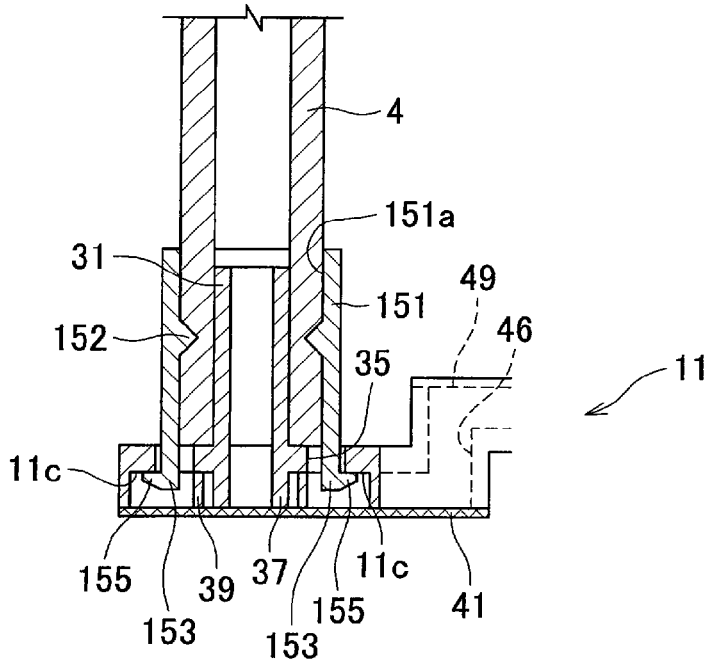

Next, a description will be given to a cap 8 that fixes the ink supply tube 4 to the joint 31 or the ink discharge tube 5 to the joint 32. FIG. 6A is a side view of the cap 8. FIG. 6B is a sectional view taken along line VIB-VIB of FIG. 6A. FIG. 6C is a plan view of the cap 8. FIGS. 7A and 7B illustrate a situation of fixing the ink supply tube 4 to the joint 31.

As shown in FIGS. 6A to 6C, the cap 8 has a cylindrical tubular portion 151, a protrusion 152, and two extending portions 153. The tubular portion 151 has such an inside diameter as to allow the ink supply tube 4 to pass therethrough. The protrusion 152 is formed on an inner surface 151*a* of the tubular portion 151. The two extending portions 153 extend downward from a lower end 151*b* of the tubular portion 151. As shown in FIG. 6B, the protrusion 152 is formed annularly around the inner surface 151*a*, and disposed near a middle of the tubular portion 151 with respect to an extending direction of the tubular portion 151. The protrusion 152 has a tapered shape, and protrudes from the inner surface 151*a* toward an axis 150 of the tubular portion 151. When the ink supply tube 4 is inserted through the tubular 151, as shown in FIG. 7A, an end of the protrusion 152 comes between an inside diameter position and an outside diameter position of the ink supply tube 4. That is, the protrusion 152 elastically deforms a wall of the ink supply tube 4 so that an outer face of the wall is recessed inward.

As shown in FIG. 6A, side faces 153*a* of each of the extending portion 153 are defined by two notches 154 that are formed along an axis 150 direction. Accordingly, a proximal end of the extending portion 153 locates closer to the middle of the tubular portion 151 than the lower end 151*b* does. The extending portion 153, which is sandwiched between the two notches 154, has a strip shape elongated in the axis 150 direction. A section of the extending portion 153 taken along a direction perpendicular to the axis 150 is similar to but slightly smaller than the holes 35, 36 formed on the passage component 3. When the axis 150 and an axis of the joint 31, 32 are aligned, the two extending portions 153 are opposed to the pair of holes 35, 36. More specifically, in a plan view as seen in the axis 150 direction, an imaginary line K1 passing through a center of one extending portion 153 and the axis 150 forms an angle of 180 degrees with an imaginary line K2 passing through a center of the other extending portion 153 and the axis 150, as shown in FIG. 6C.

The extending portion 153 has, at an end thereof, a hook 155 protruding outward. An upper face 155*a* of the hook 155 is flat. When the axis 150 and an axis of the joint 31, 32 are aligned, an end of the hook 155 comes to a position more away from the axis 150 than a peripheral edge of the hole 35, 36 is. Thus, when inserted into the hole 35, 36, the hook 155 is engaged with the step 11*c*.

Next, a description will be given an operation of fixing the ink supply tube 4 connected to the joint 31 by means of the cap 8. The same description is applicable to an operation of fixing the ink discharge tube 5 connected to the joint 32 by means of the cap 8, and therefore a description thereof is omitted.

As shown in FIG. 7A, first, the ink supply tube 4 is inserted through the cap 8. Then, a portion of the ink supply tube 4 existing outside the cap 8 covers the joint 31, so that the ink supply tube 4 is fitted with the joint 31. Consequently, an outer surface of the joint 31 is covered with the ink supply tube 4. Then, the cap 8 is put in position so that the two extending portions 153 are opposed to the pair of holes 35, as shown in FIG. 7B. Then, the cap 8 is moved down so as to cover a portion of the ink supply tube 4 fitted with the joint 31.

Since the side faces of the extending portion 153 are defined by the notches 154, the extending portion 153 can easily be bent inward. This makes it easy to insert the hook 155 into the hole 35 in order to fix the cap 8 to the passage component 11.

Moreover, the end of the hook 155 has a tapered shape, and a lower face of the end exists in a plane that obliquely intersects the axis 150. Accordingly, the hook 155 can easily be inserted into the hole 35, even though, at the time when the cap 8 is moved downward, the end of the hook 155 comes into contact with a portion of the surface 11*a* around the hole 35.

Then, the cap 8 is further moved down, to bring the hook 155 into engagement with the step 11*c*. During this process, one end of the ink supply tube 4 is kept in contact with the surface 11*a*. In this way, the ink supply tube 4 connected to the joint 31 is fixed by the cap 8. Ink passing through the ink supply tube 4 is supplied to the flow-in passage 45 via the joint 31.

Figure 8:
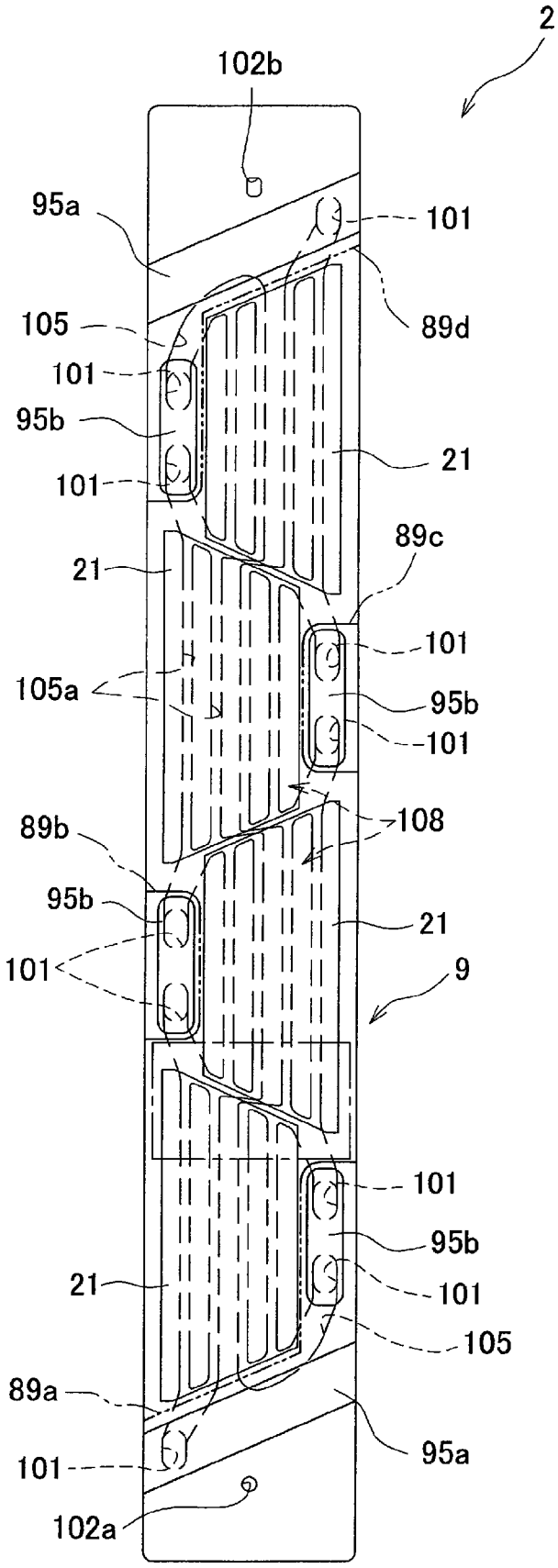
FIG. 8 is a plan view of a head main body that is included in the ink-jet head.
Figure 9:
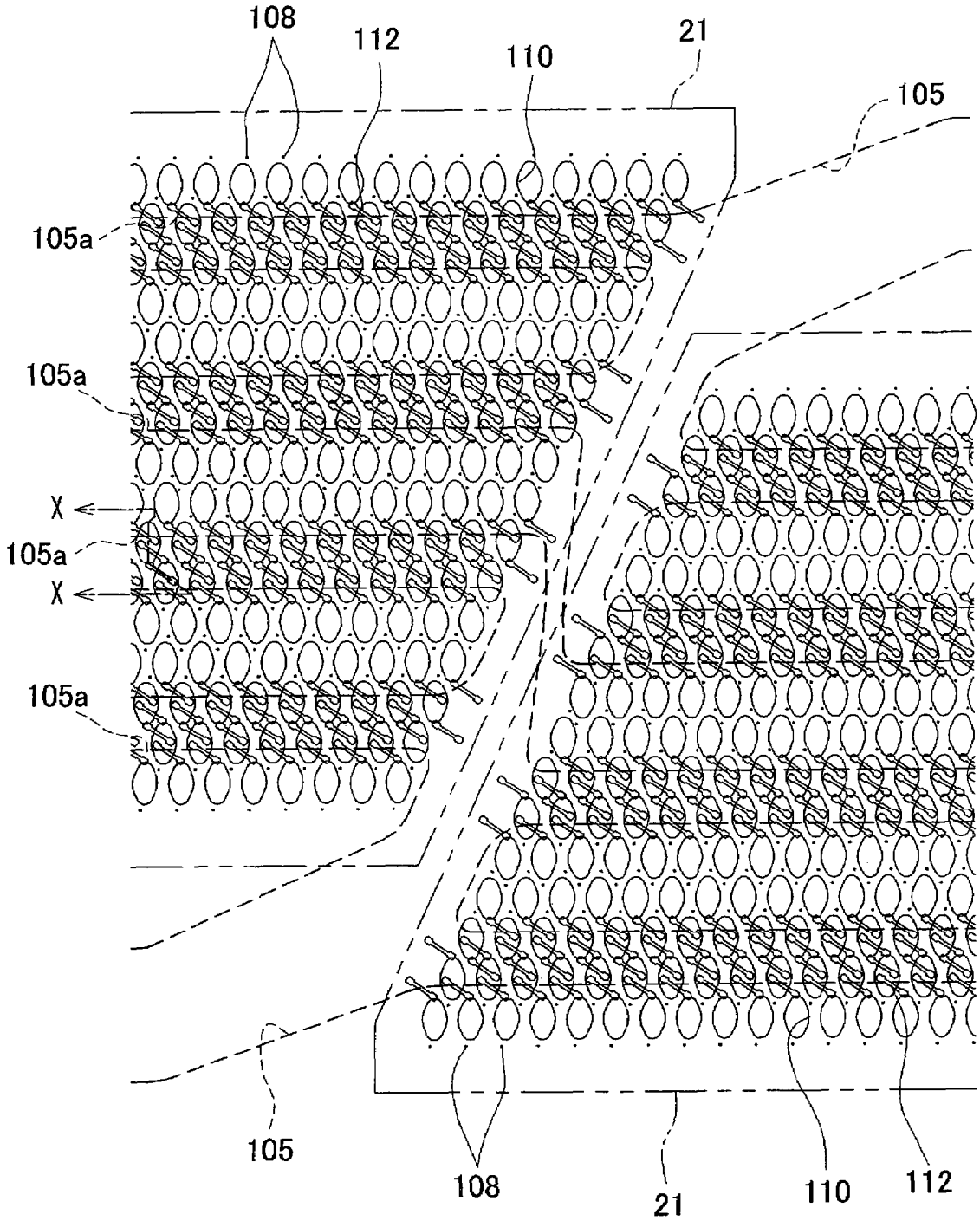
FIG. 9 is an enlarged view of a region that is, in FIG. 8, enclosed with an alternate long and short dash line.
Figure 10:
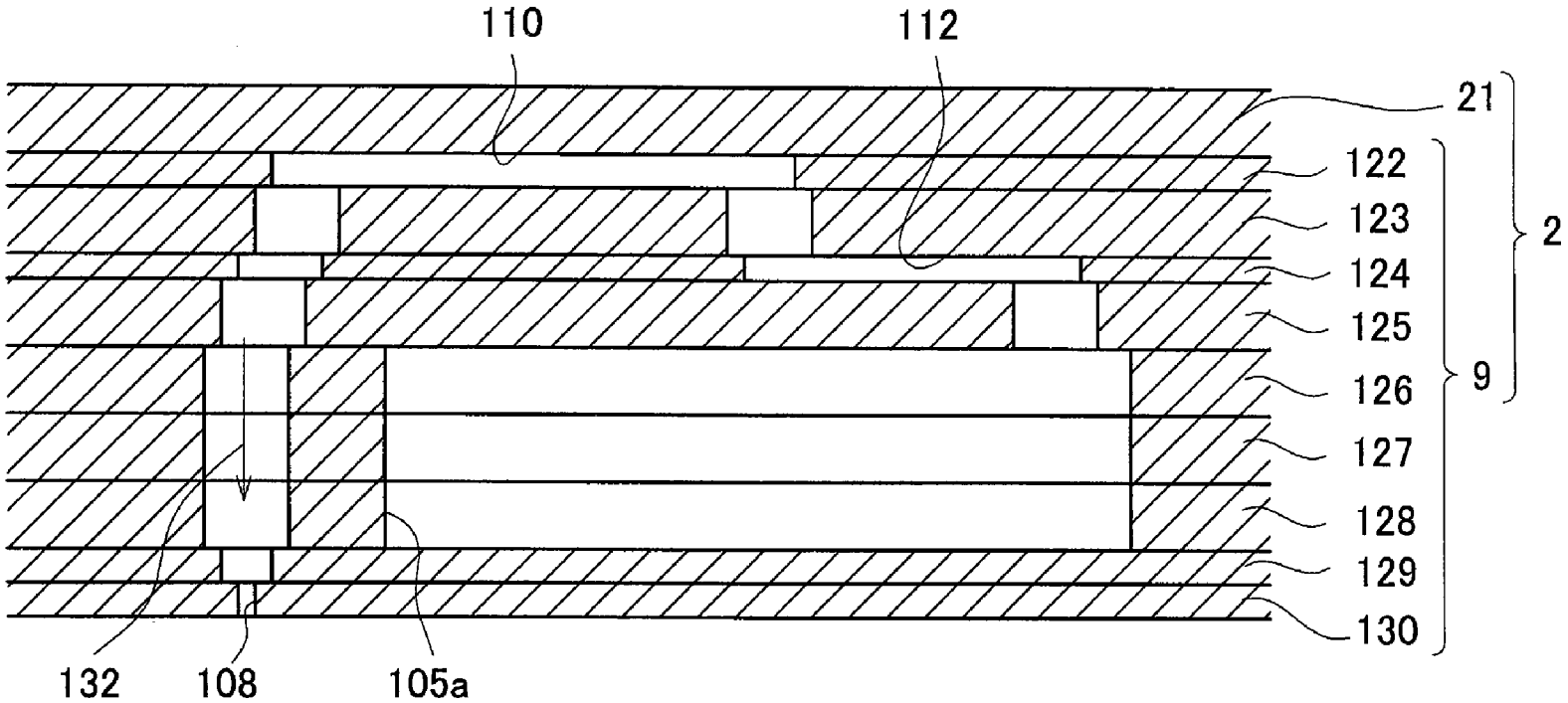
FIG. 10 is a local sectional view taken along line X-X of FIG. 9.
Figure 11A:
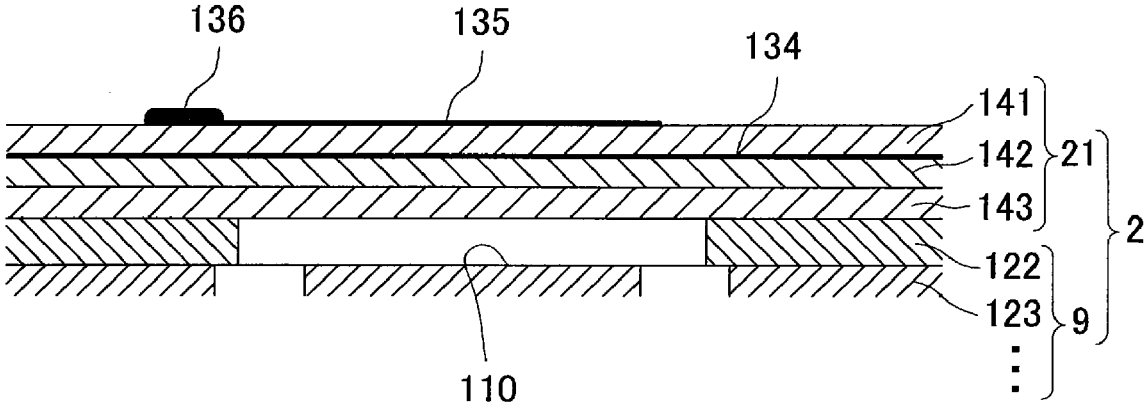
FIG. 11A is an enlarged sectional view of an actuator unit.
Figure 11B:
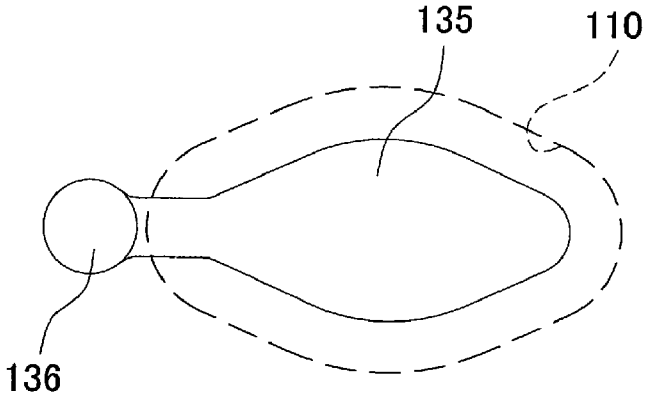
FIG. 11B is a plan view of an individual electrode that is disposed on a surface of the actuator unit.

Next, the head main body 2 will be described with reference to FIGS. 8 to 11. FIG. 8 is a plan view of the head main body 2. FIG. 9 is an enlarged view of a region that is, in FIG. 8, enclosed with an alternate long and short dash line. In FIG. 9, for the purpose of explanatory convenience, pressure chambers 110, apertures 112, and nozzles 108 are illustrated with solid lines although they locate below the actuator units 21 and therefore should actually be illustrated with broken lines. FIG. 10 is a local sectional view taken along line X-X of FIG. 9. FIG. 11A is an enlarged sectional view of the actuator unit 21, and FIG. 11B is a plan view of an individual electrode 135 that is disposed on a surface of the actuator unit 21.

As shown in FIG. 8, the head main body 2 includes the passage unit 9 and four actuator units 21 that are fixed on an upper face of the passage unit 9. The actuator unit 21 includes actuators each corresponding to each pressure chamber 110, and has a function of selectively applying ejection energy to ink contained within the pressure chambers 110 that are formed on the passage unit 9.

An outer shape of the passage unit 9 is a substantially rectangular parallelepiped shape having substantially the same width as that of the reservoir unit 3. A length of the passage unit 9 with respect to the main scanning direction is slightly smaller than that of the reservoir unit 3. As shown in FIGS. 9 and 10, a lower face of the passage unit 9 is an ink ejection face in which many nozzles 108 are arranged in a matrix. Portions of the ink ejection face which correspond to portions where the actuator units 21 are bonded act as ink ejection regions. On the upper face of the passage unit 9, many pressure chambers 110 are formed in a matrix like the nozzles 108. Formed within the passage unit 9 are many individual ink passages 132 each corresponding to each pressure chamber 110 and each nozzle 108.

Positioning holes 102*a* and 102*b* corresponding to the positioning holes 87*a*, 87*b*, 92*a*, and 92*b* of the plates 13 and 14 are formed at both longitudinal ends of the passage unit 9. By putting positioning pins through the positioning holes 87*a*, 87*b*, 92*a*, 92*b*, 102*a* and 102*b*, the passage unit 9 and the reservoir unit 3 are positioned with each other.

As shown in FIG. 10, the passage unit 9 has nine plates of, from the top, a cavity plate 122, a base plate 123, an aperture plate 124, a supply plate 125, manifold plates 126, 127, 128, a cover plate 129, and a nozzle plate 130. Each of the plates 122 to 130 is, like the plates 12 to 14 of the reservoir unit 3, made of SUS430 for example and, in a plan view, has a rectangular shape elongated in the main scanning direction (see FIG. 1).

Formed in the cavity plate 122 are through holes serving as the ink supply ports 101 (see FIG. 8) and many substantially rhombic through holes serving as the pressure chambers 110. Formed in the base plate 123 are communication holes each provided for each pressure chamber 110 so as to connect a pressure chamber 110 to an aperture 112, and communication holes each provided for each pressure chamber 110 so as to connect a pressure chamber 110 to a nozzle 108. Also formed in the base plate 123 are communication holes each connecting an ink supply port 101 to a manifold channel 105. Formed in the aperture plate 124 are through holes each provided for each pressure chamber 110 and serving as an aperture 112, and communication holes each provided for each pressure chamber 110 so as to connect a pressure chamber 110 to a nozzle 108. Also formed in the aperture plate 124 are communication holes each connecting an ink supply port 101 to a manifold channel 105. Formed in the supply plate 125 are communication holes each provided for each pressure chamber 110 so as to connect an aperture 112 to a sub manifold channel 105*a*, and communication holes each provided for each pressure chamber 110 so as to connect each pressure chamber 110 to a nozzle 108. Also formed in the supply plate 125 are communication holes each connecting an ink supply port 101 to a manifold channel 105. Formed in the manifold plates 126, 127, and 128 are communication holes each provided for each pressure chamber 110 so as to connect a pressure chamber 110 to a nozzle 108. Also formed in the manifold plates 126, 127, and 128 are through holes that cooperate with each other to constitute manifold channels 105 or sub manifold channels 105*a* when the plates are put in layers. Formed in the cover plate 129 are communication holes each provided for each pressure chamber 110 so as to connect a pressure chamber 110 to a nozzle 108. Formed in the nozzle plate 130 are through holes each provided for each pressure chamber 110 and serving as each nozzle 108.

The nine plates 122 to 130 are positioned, put in layers, and fixed to one another so that an individual ink passage 132 as shown in FIG. 10 is formed inside the passage unit 9.

As shown in FIG. 8, a total of ten ink supply ports 101 are opened on the upper face of the passage unit 9. The ten ink supply ports 101 correspond to the ink discharge holes 88 of the reservoir unit 3 (see the lowermost view of FIG. 3). Manifold channels 105 that communicate with the ink supply ports 101, and sub manifold channels 105*a* that branch from the manifold channels 105 are formed within the passage unit 9. Individual ink passages 132 are provided for the respective nozzles 108. As shown in FIG. 8, each of the individual ink passages 132 extends from a manifold channel 105 to a nozzle 108 through a sub manifold channel 105*a*, an outlet of the sub manifold channel 105*a*, an aperture 112, and a pressure chamber 110. Ink is supplied from the reservoir unit 3 through the ink supply ports 101 into the passage unit 9, and then branches from the manifold channels 105 into the sub manifold channels 105*a*, and then goes through the apertures 112 which function as throttles and the pressure chambers 110 to the nozzles 108.

The filter plates 95*a* and 95*b* that cover the ink supply ports 101 are disposed on the upper face of the passage unit 9. Each of the two filter plates 95*a* extends obliquely with respect to a widthwise direction of the passage unit 9, so as to cover the ink supply ports 101 that locate at each longitudinal end portion of the passage unit 9. Each of the four filter plates 95*b* has a shape elongated in a longitudinal direction of the passage unit 9. The ink supply ports 101 are paired and arranged in a zigzag pattern along the longitudinal direction of the passage unit 9. The four filter plates 95*b* are disposed so that each of them covers two of the ink supply ports 101. The filter plates 95*a* and 95*b* are disposed in regions to which the protrusions 89*a* to 89*d* (as illustrated with alternate long and two short dashes lines in FIG. 8) of the plate 14 of the reservoir unit 3 are fixed. By an adhesive, the filter plates 95*a* and 95*b* are bonded to portions of lower faces of the protrusions 89*a* to 89*d* except the ink discharge holes 88. Portions of the lower faces of the protrusions 89*a* to 89*d* which are not opposed to the filter plates 95*a* and 95*b* are bonded to the upper face of the passage unit 9 by an adhesive.

As shown in FIG. 8, the four actuator units 21 each having a trapezoidal shape in a plan view are arranged in a zigzag pattern so as to keep out from the ink supply ports 101 and the filter plates 95*a*, 95*b*. Parallel opposed sides of each actuator unit 21 extend along the longitudinal direction of the passage unit 9. Oblique sides of every neighboring actuator units 21 overlap each other with respect to the widthwise direction of the passage unit 9. Neighboring actuator units 21 locate equidistantly on opposite sides of a widthwise center of the passage unit 9.

As described above, the reservoir unit 3 is fixed to the passage unit 9 with the protrusions 89*a* to 89*d* therebetween. The portion of the lower face of the reservoir unit 3 other than the protrusions 89*a* to 89*d* (which is not hatched in the lowermost view of FIG. 3) is spaced apart from the passage unit 9 at an interval corresponding to a protruding height of the protrusions 89*a* to 89*d*. The actuator units 21 are fixed to portions of the upper face 9*a* of the passage unit 9 which are spaced apart from and opposed to the lower face of the reservoir unit 3. The FPCs 6 fixed on the actuator units 21 are not in contact with the lower face of the reservoir unit 3.

As shown in FIG. 11A, the actuator unit 21 includes three piezoelectric sheets 141, 142, and 143 each having a thickness of approximately 15 μm and made of, for example, a lead zirconate titanate (PZT)-base ceramic material with ferroelectricity. The piezoelectric sheets 141 to 143 are disposed so as to extend over many pressure chambers 110 that correspond to one ink ejection face.

On the uppermost piezoelectric sheet 141, individual electrodes 135 are formed at positions corresponding to the respective pressure chambers 110. A common electrode 134 having a thickness of approximately 2 μm is interposed between the uppermost piezoelectric sheet 141 and the piezoelectric sheet 142 disposed under the uppermost piezoelectric sheet 141. The common electrode 134 is formed over entire surfaces of the sheets. Both of the individual electrodes 135 and the common electrode 134 are made of an Ag—Pd-base metallic material for example. No electrode is disposed between the piezoelectric sheets 142 and 143.

The individual electrode 135 has a thickness of approximately 1 μm. In a plan view, as shown in FIG. 11B, the individual electrode 135 has a substantially rhombic shape similar to that of the pressure chamber 110. One acute portion of the individual electrode 135 extends out. Formed at an end of the acute portion is a circular land 136 having a diameter of approximately 160 μm and electrically connected to the individual electrode 135. The land 136 is made of gold including glass frits, for example. As shown in FIG. 11A, the land 136, which is placed at a predetermined position on an extending-out portion of the individual electrode 135, is electrically bonded to a contact that is provided on the FPC 6 (see FIG. 1). The position is, with respect to a thickness direction of the piezoelectric sheets 141 to 143, opposed to a wall of the cavity plate 122 defining the pressure chambers 110. That is, the position does not overlap the pressure chamber 110 with respect to the thickness direction of the piezoelectric sheets 141 to 143.

In a region not illustrated, the common electrode 134 is grounded. Thus, the common electrode 134 is, at its portions corresponding to all the pressure chambers 110, equally kept at the ground potential. In order that potentials of the respective individual electrodes 135 can selectively be controlled, the FPC 6 through which the individual electrodes 135 are connected to the driver IC 7 (see FIG. 1) includes lead wires that are provided for the respective individual electrodes 135 independently of one another. That is, a portion of the actuator unit 21 sandwiched between each individual electrode 135 and the pressure chamber 110 works as an individual actuator. The number of actuators included in the actuator unit 21 equals the number of pressure chambers 110.

Here, a driving mode of the actuator unit 21 will be described. The piezoelectric sheet 141 is polarized in its thickness direction. When the individual electrode 135 is set at a potential different from a potential of the common electrode 134, an electric field in a polarization direction is applied to the piezoelectric sheet 141. As a result, a portion of the piezoelectric sheet 141 to which the electric field is applied acts as an active portion which is distorted by a piezoelectric effect. That is, the piezoelectric sheet 141 extends or contracts in its thickness direction, and contracts or extends in a plane direction by a transversal piezoelectric effect. The other two piezoelectric sheets 142 and 143 form inactive layers not including a region sandwiched between the individual electrode 135 and the common electrode 134, and therefore cannot deform by themselves. That is, the actuator unit 21 is of so-called unimorph type, in which upper one piezoelectric sheet 141 distant from the pressure chambers 110 is a layer including active portions and the lower two piezoelectric sheets 142 and 143 closer to the pressure chambers 110 are layers including no active portions.

As shown in FIG. 11A, the piezoelectric sheets 141 to 143 are fixed on an upper face of the cavity plate 122 that partitions the pressure chambers 110. When difference occurs between plane-direction distortion of a portion of the piezoelectric sheet 141 to which the electric field is applied and plane-direction distortion of the lower piezoelectric sheets 142 and 143, the piezoelectric sheets 141 to 143 as a whole are deformed to protrude toward the pressure chamber 110 (unimorph deformation). This reduces the volume of the pressure chamber 110. Pressure inside the pressure chamber 110 rises accordingly, and ink is pushed out of the pressure chamber 110 to the nozzle 108 and then ejected from the nozzle 108. Thereafter, when the individual electrode 135 is set at the same potential as the potential of the common electrode 134, the piezoelectric sheets 141 to 143 restore the original flat shape, and the volume of the pressure chamber 110 is also returned to the original one. Ink is accordingly introduced from the manifold channel 105 into the pressure chamber 110, and thus the pressure chamber 110 is charged with ink again.

In the ink-jet head 1 of this embodiment described above, the portions of the ink supply tube 4 and the ink discharge tube 5 fitted with the joints 31 and 32 are externally covered by the cap 8. The protrusions 152 of the caps 8 press the ink supply tube 4 and the ink discharge tube 5 to the joints 31 and 32, thereby fixing the ink supply tube 4 and the ink discharge tube 5 to the joints 31 and 32. In addition, the hook 155 is engaged with the step 11*c* that is formed in the vicinity of the hole 35, 36, so that the cap 8 is fixed to the passage component 11. Therefore, as compared with when the ink supply tube 4 and the ink discharge tube 5 are merely circumferentially clamped, it is more unlikely that the ink supply tube 4 and the ink discharge tube 5 fall out of the joints 31 and 32.

The openings of the tubular walls 39 and 40 are sealed with the films 41 and 42. Accordingly, even if ink or ink mist enters the holes 35 and 36 from outside, the ink or ink mist does not flow out through the openings of the tubular walls 39 and 40. Conversely, in a case where the openings of the tubular walls 39 and 40 are not sealed, ink or ink mist, which has flown out of the holes 35 and 36 through the opening of the tubular wall 39 and 40, goes to the passage unit 9 through the positioning holes 75*a* and 75*b* of the plate 12, the positioning holes 86*a* and 86*b* of the plate 13, and the positioning holes 91*a* and 91*b* of the plate 14. Placed at positions exactly opposed to the positioning holes 91*a* and 91*b* are the filter plates 95*a* that cover the ink supply ports 101 formed at the both longitudinal end portions of the passage unit 9. However, unless the filter plates 95*a* and the protrusions 89*a*, 89*d* of the plate 14 are securely bonded to each other without any gap, ink that has entered through the positioning holes 91*a* and 91*b* reaches the actuator units 21. This may cause a short circuit between the individual electrodes 135 that are formed on an upper face of the actuator unit 21. In this embodiment, such a short circuit between the individual electrodes 135 can be prevented, because the films 41 and 42 seals the openings of the tubular walls 39 and 40.

The cap 8 has two extending portions 153. In a plan view, the imaginary line K1 passing through the center of one extending portion 153 and the axis 150, and the imaginary line K2 passing through the center of the other extending portion 153 and the axis 150 form the same angle (180 degrees) on both left and right sides thereof. As a result, hooking force of the cap 8 is uniform along a circumference of the cap 8, thus enabling the cap 8 to be more firmly fixed to the passage component 11. Therefore, it becomes still more unlikely that the ink supply tube 4 and the ink discharge tube 5 fall out of the joints 31 and 32.

Since the protrusion 152 is formed annularly around the inner surface of the tubular portion 151, holding power of the cap 8 is improved, to make it further more unlikely that the ink supply tube 4 and the ink discharge tube 5 fall out of the joints 31 and 32.

In the above-described embodiment, the hook 155 is engaged with the step 11*c* of the passage component 11. However, this is not limitative. For example, it may also be possible that recesses engageable with the hooks 155 are formed on the inner faces of the holes 35 and 36. Alternatively, it may also be possible to form a recess on the surface 11*a*, instead of the holes 35 and 36 penetrating from the surface 11*a* to the back face 11*b*, so that the hook is engaged with a periphery of the recess.

The openings of the tubular walls 39 and 40 may not necessarily be sealed with the films 41 and 42.

The ends of the annular walls 37, 38 and the ends of the tubular walls 39, 40 may not necessarily be at the same level.

The passage component may be made of a material different from a resin. The ends 37*a* and 39*a* of the annular wall 37 and the tubular wall 39 may not be tapered.

The cap 8 may have one extending portion 153, or alternatively may have three or more extending portions 153. In a case where the cap 8 has three or more extending portions 153, it is preferable that angles formed between neighboring two of imaginary lines, each of which passes through a center of each extending portion 153 and the axis 150, are the same when seen in the axis 150 direction. Thus, the extending portions 153 are arranged balancedly along the circumference of the cap 8. As a result, hooking force of the cap 8 is uniform along the circumference of the cap 8, thus enabling the cap 8 to be further more firmly fixed to the passage component 11.

The notches 154 may not always be formed in the tubular portion 151.

Although the protrusion 152 is formed annularly around the inner surface 151*a*, this is not limitative. For example, the protrusion 152 may be partially broken along the inner surface 151*a*. At least one separate, island-like protrusion may protrude inward from the inner surface 151*a*. Also, some protrusions that extend in parallel with the axis 150 may be formed on the inner surface 151*a*. In such a case, it is easy to, while securing holding power of the cap 8, move the cap 8 in order to bring the hooks 155 into engagement with the hole 35, 36.

The end of the hook 155 may not be tapered. In addition, the lower face of the end of the hook 155 may not exist in the plane that obliquely intersects the axis 150.

The ink-jet head according to the present invention is not limited to piezo-type ink-jet heads, and may be thermal-type ink-jet heads, electrostatic-type ink-jet heads, and the like. Moreover, applications of the ink-jet head according to the present invention are not limited to printers. It is also applicable to ink-jet type facsimiles or copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising: a flexible tube; a passage component; a tubular joint that protrudes from a surface of the passage component and is fitted into the tube; and a cap that covers a portion of the tube fined with the joint, wherein:

a hole is formed on the surface of the passage component;

the cap includes a tubular portion that has an inner surface to contact with an outer surface of the portion of the tube fitted with the joint and has such an inside diameter as to allow the tube to pass therethrough, a protrusion that protrudes inward from the inner surface of the tubular portion such that the protrusion engages with a recess on the outer surface of the tube, and an extending portion that extends toward the hole from an end of the tubular portion confronting the surface of the passage component;

an end of the protrusion is positioned between an inside diameter position and an outside diameter position of the portion of the tube fitted with the joint; and a hook engageable with a peripheral edge of the hole is formed at the extending portion.

2. The ink-jet head according to claim 1, wherein:

the hole penetrates from the surface to a back face of the passage component opposite to the surface;

the passage component has an ink passage that carries therethrough any one of ink supplied from the tube through the joint and ink which will be discharged into the tube through the joint;

a part of the ink passage is formed by a space enclosed with an annular wall that protrudes from the back face so as to surround a region of the back face corresponding to the joint, a film that seals an opening at an end of the annular wall, and the back face; and the film seals an opening at an end of a tubular wall that protrudes from the back face so as to surround the hole.

3. The ink-jet head according to claim 2, wherein the end of the annular wall and the end of the tubular wall are at the same level with respect to a direction perpendicularly crossing the back face.

4. The ink-jet head according to claim 2, wherein:

the passage component is made of a resin; and the end of the annular wall and the end of the tubular wall have tapered shapes.

5. The ink-jet head according to claim 1, wherein:

a plurality of the extending portions are formed at the end of the tubular portion; and angles formed between neighboring two of lines, each of which passes through a center of each extending portion and an axis of the tubular portion, are the same when seen in an axial direction of the tubular portion.

6. The ink-jet head according to claim 1, wherein side faces of the extending portion are defined respectively by two notches that are formed in the tubular portion.

7. The ink-jet head according to claim 1, wherein the protrusion is formed annularly around the inner surface of the tubular portion.

8. The ink-jet head according to claim 1, wherein:

an end of the hook has a tapered shape; and a face of the end of the hook facing toward an extending direction of the extending portion exists in a plane that obliquely intersects the axis of the tubular portion.

* * * * *